United States Patent [19]

Swanson et al.

[11] 3,951,296

[45] Apr. 20, 1976

[54] REINFORCED WALL-IRONED CONTAINER

[75] Inventors: William D. Swanson, Coraopolis, Pa.; Edward P. Spencer, Steubenville, Ohio

[73] Assignee: National Steel Corporation, Pittsburgh, Pa.

[22] Filed: July 29, 1974

[21] Appl. No.: 492,853

Related U.S. Application Data

[60] Continuation of Ser. No. 177,322, Sept. 2, 1971, abandoned, which is a division of Ser. No. 795,428, Jan. 31, 1969, Pat. No. 3,610,018.

[52] U.S. Cl. ..... 220/72; 72/349; 113/120 H; 113/120 W; 220/DIG. 22

[51] Int. Cl.[2] ..... B65D 7/46; B65D 1/44

[58] Field of Search ..... 220/5 R, 5 A, 71–74, 220/DIG. 22; 72/349, 370; 113/120 G, 120 H, 120 W, 116 QA

[56] References Cited

UNITED STATES PATENTS

| | | | |
|---|---|---|---|
| 1,715,683 | 6/1929 | Stevens | 220/72 |
| 1,944,527 | 1/1934 | Pfaendler | 220/DIG. 22 |
| 2,603,177 | 7/1952 | Gardiner | 220/72 |

FOREIGN PATENTS OR APPLICATIONS

| | | | |
|---|---|---|---|
| 1,153,008 | 2/1958 | France | 220/5 A |
| 873,534 | 4/1953 | Germany | 72/349 |
| 549,909 | 12/1942 | United Kingdom | 29/553 |
| 518,618 | 3/1940 | United Kingdom | 220/3 |

*Primary Examiner*—George E. Lowrance
*Attorney, Agent, or Firm*—Shanley, O'Neil and Baker

[57] ABSTRACT

A wall-ironed container having annular reinforcing ribs projecting inwardly from the inside surface of the side walls, the ribs being spaced from the ends of the side walls and from each other, the outer surface of the side walls of the container being in the form of a cylinder.

8 Claims, 10 Drawing Figures

FIG. 1
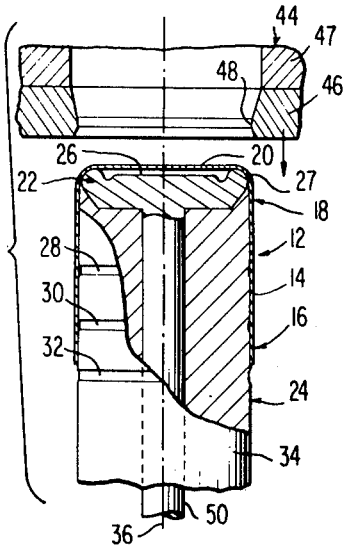
FIG. 3
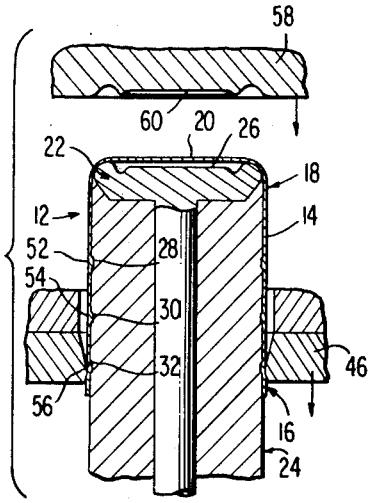
FIG. 5
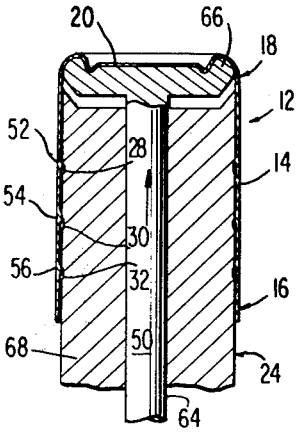
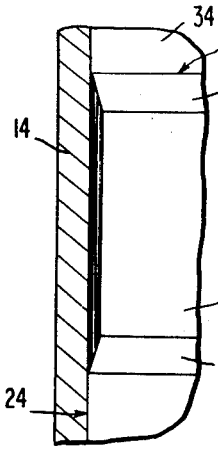
FIG. 2
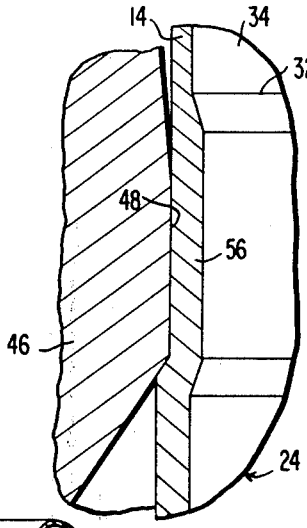
FIG. 4
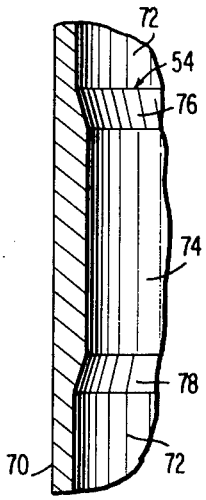
FIG. 7
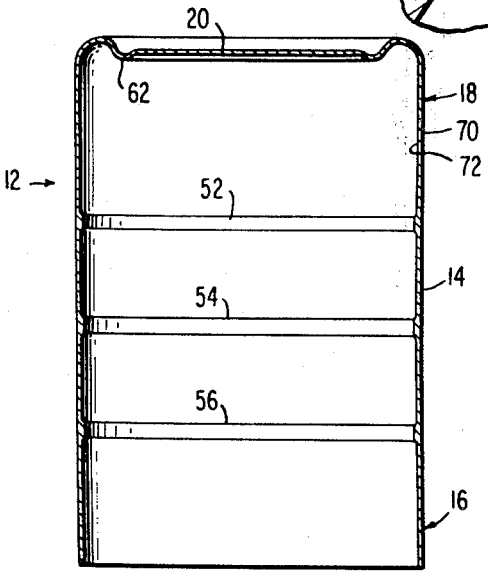
FIG. 6

REINFORCED WALL-IRONED CONTAINER

CROSS-REFERENCE TO RELATED APPLICATION

This application is a continuation of our copending patent application Ser. No. 177,322 filed Sept. 2, 1971, now abandoned, which in turn was a division of our then copending patent application Ser. No. 795,428, filed Jan. 31, 1969, now U.S. Pat. No. 3,610,018.

BACKGROUND OF THE INVENTION

The side walls of sanitary containers must have sufficient resistance to buckling to withstand pressure differentials established in packing food and other goods, and to withstand handling, packing and shipping. In the past, the necessary buckling resistance has been established in wall-ironed metal containers by any of a number of expedients, none of which is satisfactory.

One prior technique is to increase overall side wall thickness, and is disadvantageous because it requires an excessive amount of material and is thus costly. A second expedient has been to deform the side walls to form beads, which are circumferential corrugations in the side walls. This is disadvantageous because beading is an extra step in the containermaking process, and thus increases production costs. Also, beading is objectionable because it alters the otherwise smooth, attractive appearance of the outside surface of the side walls, and can interfere with labeling.

A third proposal has been to provide the ironing punch used to make the containers with a reduced-diameter portion tapering inwardly to the free end portion of the punch. This produces an increased-thickness portion in the side walls contiguous to the container end closure. The punch taper is located at the free end portion of the punch so that the thick side wall portions do not interfere with punch extraction. This technique is disadvantageous in that strengthening is confined to one end portion of the side walls. The central portion is not strengthened, and the central portion is where strength is most needed because the can end closures serve to stiffen contiguous side wall portions.

Main objects of the invention are provision of improved wall-ironed containers having increased buckling resistance, without increasing overall wall thickness, without requiring an extra operation such as beading, and with a minimum use of material.

Other objects and advantages of the invention will appear from the following detailed description which, in connection with the accompanying drawings, discloses two embodiments of the invention for purposes of illustration only and not for determination of the limits of the invention. For defining the scope of the invention, reference will be made to the appended claims.

BRIEF DESCRIPTION OF THE DRAWINGS

In the drawings, where similar reference characters denote similar elements throughout the several views:

FIG. 1 schematically illustrates an early stage in formation of containers in accordance with one embodiment of the invention;

FIG. 2 is a magnified detail view of the structure of FIG. 1;

FIG. 3 depicts a later stage in the container-making operation;

FIG. 4 is a magnified, detail view of the structure of FIG. 3;

FIG. 5 schematically illustrates a still later stage in the container-making operation;

FIG. 6 depicts a container body produced by the operations of FIGS. 1–5;

FIG. 7 is a magnified detail view of the container body of FIG. 6;

DESCRIPTION OF THE ILLUSTRATED EMBODIMENTS

Figure 8:
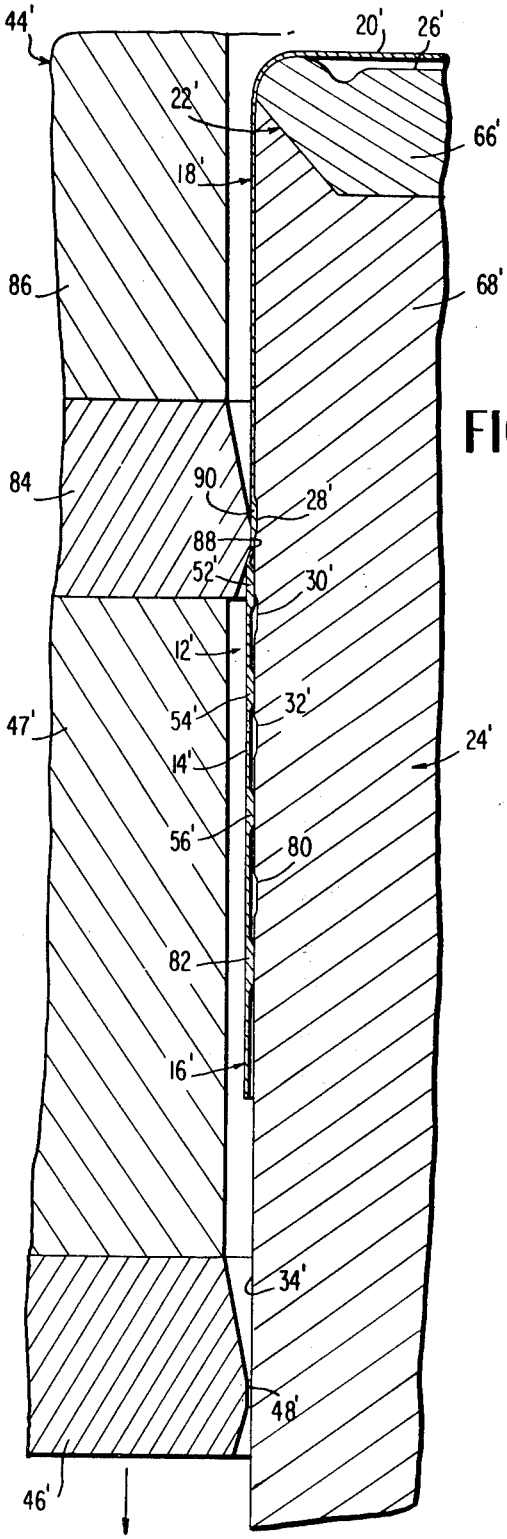
FIG. 8 schematically illustrates formation of containers in accordance with another embodiment of the invention.

In FIG. 1, a metal blank in the form of a cup having a circular cross section is generally indicated at 12. The cup has continuous side walls 14, which have opposite end portions generally indicated at 16, 18, respectively. A cup end closure 20 is unitary with side walls 14. Cup 10 is made of metallic material, preferably tinplated steel, and can be produced by any suitable, conventional procedure, e.g., deep drawing from a single piece of sheet stock.

Cup 12 is positioned on a free end portion 22 of a cylindrical ironing punch or stake 24. This positioning can be effected in any suitable, conventional manner, e.g., by inserting the punch in a preformed cup, or by forming the cup earlier in the ironing stroke. In any event, cup end closure 20 opposes punch free end surface 26. End portion 18 of side walls 14 is contiguous to punch free end portion 22.

Three grooves 28, 30, 32, are formed in series in the outer periphery of punch 24. The grooves are circumferential, i.e., they extend in the direction of the circumference of the punch. In the embodiment illustrated, grooves 28, 30, 32 are not only circumferential, but also extend completely around the punch perimeter, and are circular. The diameter of punch 24 is uniform along its length, except at the grooves, to the location where curved outer peripheral portion 27 of free end surface 26 tangentially joins cylindrical outer peripheral punch surface 34. It is convenient to consider that a corresponding point of tangency divides cup side walls 14 from the cup end closure.

Grooves 28, 30, 32 are spaced from one another along longitudinal axis 36 of punch 24, and are spaced axially from free end portion 22 of punch 24. The configurations of the grooves are identical, so description of one will impart understanding of all.

Although the grooves are quite small, they are discrete, i.e., individually distinct (see FIG. 2). Groove 30 is deepest at its central portion, progressively increasing in depth from the edges toward the central portion. The central portion is defined by a cylindrical wall 38 which is spaced inwardly from and parallel to cylindrical punch surface 34. The opposite sides of the groove are defined by sloping walls 40, 42 respectively, which incline from punch surface 34 to central wall 38 of groove 30.

Punch 24 is adjacent an ironing die 44 (FIG. 1) having a single ironing ring 46 and a backing ring 47. Ring 46 includes an aperture 48 having a central axis coincident with punch axis 36, for passage of punch 24 through ring 46. The diameter of aperture 48 is greater than the inside diameter of side walls 14, which corresponds to the punch diameter, so that the cup can pass through the ring. However, the diameter of aperture 48 is less than the outside diameter of side walls 14, so the side walls will be reduced in thickness by passage of the cup through the ring.

Die 44 and punch 24 are operatively associated with a press (not shown) which can be of any type of conventional design suitable to establish relative movement between the punch and ring along axis 36 to effect passage of cup 12 on punch 24 through ring 46. Such passage can be effected by physically moving either or both of punch 24 and ring 46. In the drawings, die 44 moves downwardly over punch 24. The punch includes a conventional stripping device 50 for removing the cup from the punch after wall ironing.

When cup 12 passes through ring 46 (FIGS. 3,4) side walls 14 are reduced in thickness, and elongated, by plastic metal flow forced by the ironing ring. Further, the passing of cup 12 through ring 46 forces metal of side walls 14 to flow plastically into each groove to form a reinforcing rib on the side walls at the location of each groove. Preferably, the metal fills the grooves. Thus, reinforcing ribs 52, 54, 56 are formed in grooves 28, 30, 32 respectively.

Because the grooves are located at a distance from free end portion 22 of punch 24, plastic flow of metal into the grooves is effected at a location spaced from the side wall end portion 18 which is contiguous to the free end portion of the punch. The grooves are spaced from free end portion 22 a distance less than the length of the ironed side walls, so the reinforcing ribs are formed by plastic metal flow at a location spaced from side wall end portion 16. This will be more apparent from a consideration of FIG. 6, which depicts the cup after wall ironing is completed and the cup has been stripped from the punch. In FIG. 3, wall ironing is not completed, so full elongation of the side walls has not yet been effected and reinforcing rib 56 is closer to side wall end portion 16 than it will be at completion of ironing.

Before the ironing operation was initiated (FIG. 1), groove 32, which molds rib 56, is actually below side wall end portion 16, outside the cup. At the ironing stage of FIG. 3, groove 32 is inside the cup and moving away from side wall end portion 16, due to the elongation of the side walls under the action of the ironing ring. At completion of ironing (FIG. 6), the reinforcing ribs 52, 54, 56 formed by the three grooves are clustered generally at the central portion of the length of ironed side walls 14.

Appropriate location of the grooves produces reinforcing ribs spaced away from end closure 20 and from side wall end portion 16, where side wall reinforcement is most needed and thus most effective. The location of the grooves can be readily determined from the amount of elongation to be effected on the side walls by any given ironing operation. The amount of elongation in turn depends on the amount of thickness reduction to be effected on the side walls.

During a late stage in the ironing stroke, a stiffening curvature is imparted to cup end closure 20 by pressing the end closure between punch 24 and a shaping die 58 (FIG. 3). This can be effected in any suitable, conventional manner involving movement of punch 24 and/or die 58 to press the end closure between them. In FIG. 3, die 58 moves downwardly against punch 24. Die surface 60 conforms to the curvature of punch end surface 26, so that end closure 20 is formed to the stiffened profile which is shown in FIG. 6 and includes a circular corrugation 62.

After completion of the ironing operation, relative movement is effected between stripper 50 (FIG. 5) and annular body portion 68 of punch 24 along the punch axis to strip the ironed cup from the punch. In the drawings, stripper 50 is moved upwardly relative to body portion 68. Stripper head 66, which engaged end closure 20 during deformation of the end closure, applies to the end closure axially directed forces tending to effect separation of cup 12 from annular body portion 68. Such forces, applied through stripper shaft 64, are of magnitudes to overcome the forces tending to retain the cup on body portion 68. The latter forces include forces established by the interlocking of the reinforcing ribs with the grooves of the punch. Because of this interlocking, the ironed side walls must undergo expansion radially outwardly from the punch axis before the cup can be stripped from the punch. The axially directed forces applied to end closure 20 effect such expansion by forcing the ribs to ride up out of the grooves and along the punch. The inclination of the side walls of the grooves facilitate the movement of the ribs up out and over the grooves by providing a gradual transition zone, and further aid stripping by translating a component of the axially directed separating forces into radially outwardly directed forces tending to exapand the cup side walls. Such expansion as is undergone by the side walls includes expansion within the elastic limit of the metal and, depending on such factors as rib thickness, can include a limited amount of plastic expansion, particularly at the rib sites. In the stripping operation, the relative movement of the parts is effected over a distance to completely extract annular body portion 68 from cup 12. This is followed by extraction of stripper 50, which is retracted so that stripper head 66 engages annular body portion 68 as shown in FIG. 1.

The side walls 14 of the ironed cup 12, which can now be termed a container body, have a cylindrical outside surface 70 (FIG. 6). Side walls 14 also have a cylindrical inside surface 72 from which reinforcing ribs 52, 54, 56 project into the interior of the container body at spaced locations along inside surface 72, interrupting an otherwise continuous surface 72. The ribs, having been formed by plastic flow of metal of the side walls, are unitary and integral with the side walls. As a result of the wall ironing and plastic metal flow, the metal of the side walls, including the reinforcing ribs, is cold worked. Having been molded by the grooves, the reinforcing ribs are complementary in shape to the grooves and are identical in configuration, so a description of one will impart understanding of all.

Reinforcing rib 54 (FIG. 7) has a cylindrical central surface 74 which is spaced inwardly from and is parallel to inside surface 72 of side walls 14. Rib 54 has frustoconical, sloping surfaces 76, 78, which are respectively located on opposite sides of central surface 74, and are inclined from inside surface 72 to central rib surface 74. The sloping or wedging surfaces 76, 78 facilitate the stripping operation by translating axially directed stripping forces into radially directed forces tending to cause expansion of the side walls, and by providing gradual transition regions which assist rib 54 to ride up out of the groove, coacting in these respects with the sloping side walls 40, 42 of groove 30.

Outside surface 70 of container body 12 is parallel to inside surface 72 all along the length of side walls 14 (FIG. 6). This is a result of cylindrical punch 24 having its outer peripheral surface normal to the plane of the ironing ring. Since the punch is cylindrical and has a diameter which is uniform at all locations displaced from the grooves, side walls 14 were reduced by the wall ironing to a thickness which is uniform from end to end of the side walls at locations displaced from the ribs. Thus, the ribs are separated from one another and from the ends of the side walls by wall portions of a uniform thickness which is less than the thickness of the ribs. This provides for maximum economy of material in the walls, and as will appear, containers in accordance with the invention combine such economy with remarkably increased resistance to buckling.

Figure 9:
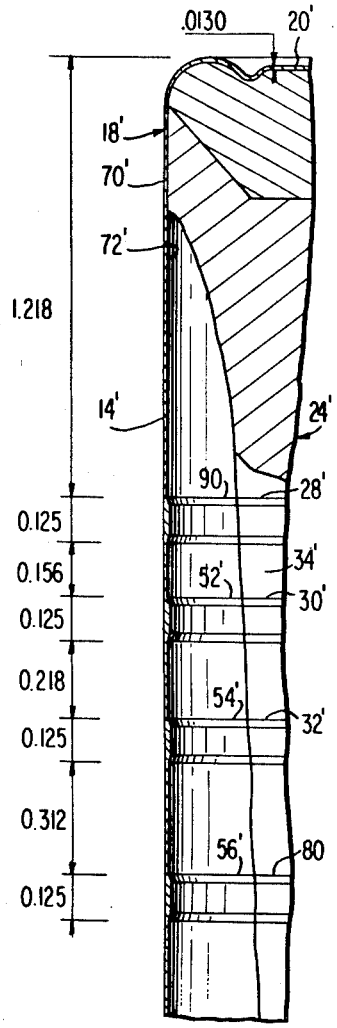
FIG. 9 schematically illustrates a later stage in the operation of FIG. 8.
Figure 10:
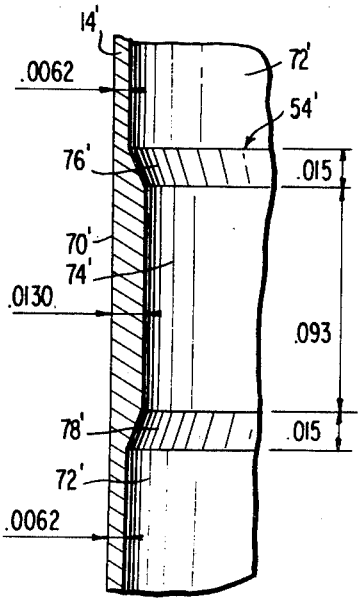
FIG. 10 is a magnified detail view of the structure of FIG. 9.

Since the amount of thickness reduction and elongation that can be effected by one ironing ring is limited, it is usually necessary to pass a cup through a plurality of ironing rings to obtain a container body of desired length. FIGS. 8–10 depict a multiple-ring ironing operation in accordance with the invention. In FIGS. 8–10, primed reference characters denote elements which are similar to corresponding elements discussed hereinabove except in particulars to be described.

In FIG. 8, side walls 14' of cup 12' have been ironed on punch 24' by ring 46' in accordance with the procedure discussed in connection with FIGS. 1–7. Punch 24' includes four grooves 28', 30', 32' and 80, the latter of which is identical in configuration to the others. Four reinforcing ribs 52', 54', 56' and 82 were formed by plastic flow of metal of side walls 14' into grooves 28', 30', 32', and 80, respectively, with reduction in side wall thickness by passage of cup 12' through ring 46'.

Ironing die 44' includes a second ironing ring 87 which is spaced axially from first ironing ring 46', and is backed by a ring 86 which is similar to backing ring 47'. Ironing ring 84 includes a circular aperture 88 having an axis coincident with the axis of aperture 48' in ring 46'. The diameter of aperture 88 is slightly smaller than the outside diameter of cup 12' as ironed by ring 46', to further reduce in thickness and elongate side walls 14' on passage of cup 12' through ironing ring 84. Passage of cup 12' through ring 84 is effected later in the same stroke of die 44' as effects passage of cup 12' through first ironing ring 46'.

As side walls 14' elongate under the action of second ironing ring 84, the reinforcing ribs move out of the respective grooves in which they were formed and along punch 24'. The ribs move ahead of ring 84 with the elongating side walls, as shown in FIG. 8. To prevent their destruction by second ironing ring 84, three of the four originally formed reinforcing ribs are relocated in other grooves before being overtaken by the second ironing ring. Thus, rib 52' moves from groove 28' into groove 30', rib 54' moves from groove 30' to groove 32', and rib 56' moves from groove 32' into groove 80. Fourth rib 82, which was formed in groove 80 by passage of ring 46', is wiped out, or substantially so, against outer peripheral surface 34' of punch 24' when rib 82 is overtaken by second ironing ring 84. Rib 82 can be saved if desired by provision of a fifth groove at a location on punch 24' appropriate to receive the rib before it is overtaken by ironing ring 84.

Second ironing ring 84 plastically flows metal of side walls 14' into uppermost groove 28' to form a reinforcing rib 90, so that after passage of ring 84, side walls 14' still have four reinforcing ribs. Depending upon the thickness reduction taken by the second ironing ring in relation to the depth of the grooves, the thickness of reinforcing rib 90 may not be as great as that of the earlier-formed ribs, which are protected from thickness reduction by ironing ring 84 by virtue of being received in other grooves when passed over by the second ironing ring. This is not to say that the first-formed ribs cannot be reduced in thickness to some extent while received in the grooves, but whether or not such reduction is effected depends on the groove depth and other parameters of a given ironing operation. In this connection, it should be noted that passage of the first ring need not fill the grooves. It can be left for the later ironing ring or rings to complete the filling of the grooves.

It is thus apparent that, in plural-ring ironing, the amount of elongation under the second ironing ring is a factor which governs groove location, in addition to those factors discussed in connection with FIGS. 1–7 which are required to assure that plastic metal flow is effected at locations to produce reinforcing ribs spaced from the opposite end portions of the side walls where most needed. Strategic location of the grooves on punch 24' makes it possible to move the first-formed reinforcing ribs along the punch from one groove into another. The groove locations can be determined from the extent of thickness reduction to be taken by the second ironing ring, volume of metal, and other variables which depend upon the size of container to be produced. Rib thickness and spacing can vary greatly relative to and with the size of the container. However, to obtain the maximum benefits of the invention in terms of material economy, the ribs should be as small as possible, and spaced apart as far as possible, in consonance with minimum strength requirements for any given container. FIGS. 9–10 provide illustrative values (in inches) of groove and rib dimensions and locations for production of a conventional 303 × 406 tin can or sanitary container body from a steel cup having a uniform side wall and end closure thickness of 0.0130 inch, with a first ironing ring reducing the side wall thickness to 0.0097 inch, and a second ring to 0.0062 inch. Under such operating conditions, although all grooves are of identical dimensions, top rib 90 will have a thickness of 0.0097 inch (including the elsewhere-uniform wall thickness of 0.0062 inch) instead of 0.0130 inch, because the second thickness reduction is insufficient for side wall metal to completely fill groove 28' on passage of second ironing ring 84. The other ribs have dimensions corresponding to the grooves, since the grooves are completely filled. Sloping walls 76', 78' of rib 54' (FIG. 10) incline at an angle of 24° from side wall surface 72' to central rib surface 74'. Other wedge angles can be used.

After completion of passage of cup 12' through second ironing ring 84, the cup is stripped from punch 24' in the fashion discussed hereinabove in connection with FIG. 5. The stripped cup can be edge-trimmed, filled, and lock-seamed to an end closure in any suitable, conventional manner.

Containers with reinforcing ribs made in accordance with the invention combine remarkably increased strength against buckling with minimal additional material usage. For example, a conventional 303 × 406 wall-ironed steel can or sanitary container with the body having four reinforcing ribs described in connection with FIGS. 8–10 resists buckling until pressure externally of the can is 19.8 psi in excess of the internal pressure. This level of buckling resistance is entirely satisfactory. In constrast, a can identical thereto except for absence of the reinforcing ribs buckles at an external pressure 12.5 psi in excess of internal pressure. This level of buckling resistance is unsatisfactory. The four reinforcing ribs produce a surprising 58% increase in buckling strength, and do so with minimal additional material. The axial width of each reinforcing rib is only about one/thirty-fifth of the container length.

Reinforcing ribs made during wall ironing in accordance with the invention provide great rigidity against buckling. Marked increases in resistance to buckling are obtained without increasing overall wall thickness, without resort to an additional operation such as beading, and with reinforcement of the container side walls where the need is greatest. Further, these achievements have been effected with maximum material economy. The extent of material economy will be more fully appreciated when the material saving in one container are multiplied by the millions of sanitary containers employed to protect and preserve food and other goods.

It will be noted that the container body formed from drawn and ironed cup 12 has a single axis of symmetry and that a plane which contains the axis of symmetry will intersect the outside surface 70 of the side walls throughout their entire area along straight lines parallel to one another.

Although the invention has been described in connection with two embodiments, modifications of the illustrated embodiments can be made. Such modifications are within the scope of the invention as defined by the appended claims.

We claim:

1. A wall-ironed metallic container formed of cold work hardenable metal comprising:

a hollow, metallic body having ironed side walls and having an end closure unitary with the side wall, the side wall having an inside surface and having a first end portion contiguous to the end closure and a second end portion opposite the first end portion, and a plurality of spaced-apart discrete, continuous circumferential reinforcing ribs, each reinforcing rib being spaced from the second end portion of the side walls, each reinforcing rib being unitary and integral with the side walls and projecting from the inside surface of the side walls at locations spaced from the first end portion of the side walls, the metal of each rib being in cold worked condition by virtue of having been formed by plastic metal flow from the metal of the side walls during the ironing of the side walls, the hollow body having a single axis of symmetry, a plane including the axis of symmetry intersecting the outside surface of the side walls throughout their entire area along straight lines parallel to one another, the side walls having a thickness which is uniform from the first end portion to the second end portion of the side walls at locations displaced from each reinforcing rib, each reinforcing rib including a central surface parallel to the inside surface of the side walls, each reinforcing rib also including a pair of wedging surfaces on opposite sides of the central surface, the wedging surfaces inclining from the inside surface of the side walls to the central surface of the reinforcing rib, the thickness of the side walls being not greater than the thickness of conventional tin can side walls.

2. The container of claim 1, the side walls at the thickest portion of each rib having a thickness not substantially greater than about twice the thickness of the side walls at locations displaced from a reinforcing rib.

3. The container of claim 2, the axial width of each rib being in the neighborhood of one/thirty-fifth of the container length.

4. The container of claim 1, the axial width of each rib being in the neighborhood of one/thirty-fifth of the container length.

5. The container of claim 1 in which there are not less than three ribs, the spacing between the second rib and the third rib from the end closure being greater than the spacing between the first rib and the second rib from the end closure by an amount proportional to the reduction effected in a second wall ironing operation during manufacture of the container.

6. The container of claim 2 in which there are not less than three ribs, the spacing between the second rib and the third rib from the end closure being greater than the spacing between the first rib and the second rib from the end closure by an amount proportional to the reduction effected in a second wall ironing operation during manufacture of the container.

7. The container of claim 3 in which there are not less than three ribs, the spacing between the second rib and the third rib from the end closure being greater than the spacing between the first rib and the second rib from the end closure by an amount proportional to the reduction effected in a second wall ironing operation during manufacture of the container.

8. The container of claim 4 in which there are not less than three ribs, the spacing between the second rib and the third rib from the end closure being greater than the spacing between the first rib and the second rib from the end closure by an amount proportional to the reduction effected in a second wall ironing operation during manufacture of the container.

* * * * *